US006012611A

United States Patent [19]

Schroeder

[11] Patent Number: 6,012,611

[45] Date of Patent: Jan. 11, 2000

[54] BAG-IN-BOX BOX AND METHOD

[75] Inventor: Alfred A. Schroeder, San Antonio, Tex.

[73] Assignee: The Coca-Cola Company, Atlanta, Ga.

[21] Appl. No.: 08/665,133

[22] Filed: Jun. 14, 1996

[51] Int. Cl.[7] ..... B65D 35/56; B67D 5/42

[52] U.S. Cl. ..... 222/105; 222/386.5

[58] Field of Search ..... 222/1, 95, 105, 222/183, 386.5, 214

[56] References Cited

U.S. PATENT DOCUMENTS 4,484,697 11/1984 Fry, Jr. .
4,815,631 3/1989 Eeg et al. .
5,000,351 3/1991 Rudick .

FOREIGN PATENT DOCUMENTS 1161713 8/1969 United Kingdom .

*Primary Examiner*—Kevin Shaver
*Assistant Examiner*—Keats Quinalty
*Attorney, Agent, or Firm*—Thomas C. McThenia, Jr.; Thomas R. Boston

[57] ABSTRACT

A box, and the method for use thereof, for a concentrate bag-in-box package for use with bags having a discharge tube for use with beverage dispensers having peristaltic pumps, the box having a tear flap defining a plurality of different tube opening locations, whereby different size packages can be used even though their center line does not line up with the tube passageway in the pump.

7 Claims, 3 Drawing Sheets

BAG-IN-BOX BOX AND METHOD

BACKGROUND OF THE INVENTION

This invention relates to postmix beverage dispensers of the type using a peristaltic pump located below a bag-in-box package of concentrate, and in particular to an improved box for the bag-in-box package and method for use thereof.

Postmix beverage dispensers are known that employ a peristaltic pump located below a chamber adapted to receive the concentrate in a bag-in-box container. The container employs a tear flap defined by a line of perforations in the corrugated box. This tear flap is torn open, and the operator reaches through the opening to grasp and withdraw an elongated, flexible, resilient discharge tube. A cover over the pump is opened and the tube is then positioned into the peristaltic pump and through a shut-off clamp. The cover is then closed and the clamp shuts off the tube. The closed end of the tube is then snipped off with scissors, and the concentrate is ready for dispensing. The opening in the box is in alignment with the tube passageway through the pump.

It is an object of the present invention to provide a box (and related method of use) having a plurality of different opening locations for the tube.

It is another object of this invention to provide a box (and related method of use) for a concentrate bag-in-box that allows the bag-in-box to be used in such dispensers even though the center of the box is not in alignment with the tube passageway of the peristaltic pump.

SUMMARY OF THE INVENTION

A box for a concentrate bag-in-box for a postmix dispenser of the type using peristaltic pumps, comprising a box wall having a plurality of tube openings in different locations on said wall.

A method for installing a concentrate bag-in-box in a postmix dispenser of the type having a peristaltic pump, comprising providing a box having a wall with a plurality of different tube openings, selecting that tube opening that is in alignment with the tube passageway in the pump, opening that selected tube opening, pulling the tube out that opening, inserting the package into the dispenser and positioning the tube in the pump.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 4:
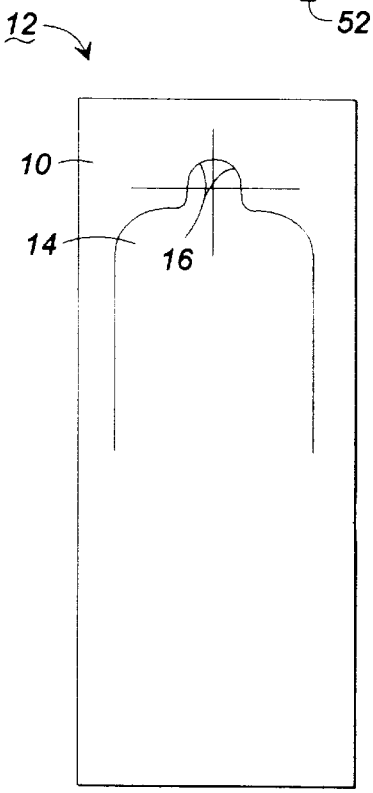
FIG. 4 is a bottom plan view of a prior art box.

With reference now to the drawings, FIG. 4 shows the bottom wall 10 of a prior art box 12 having a tear flap 14 that can be manually torn open to provide a tube opening 16 for the discharge tube of a bag of concentrate located in the box.

Figure 1:
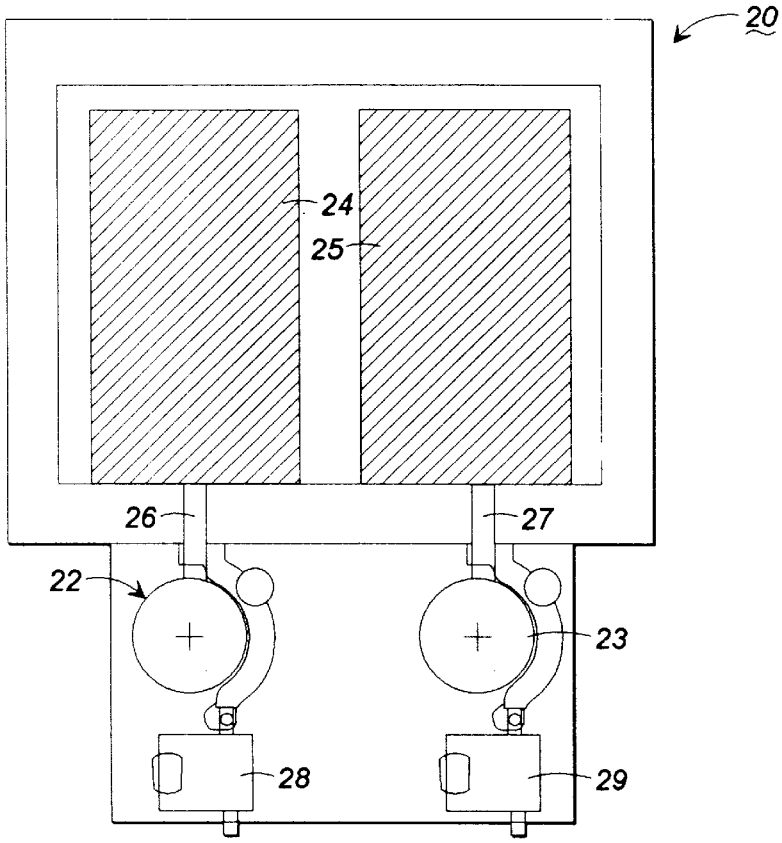
FIG. 1 is a diagrammatic front elevational view of a prior art dispenser and package.

FIG. 1 shows a prior art dispenser 20 having two peristaltic pumps 22 and 23, two bag-in-boxes 24 and 25, two discharge tubes 26 and 27, and two tube clamps 28 and 29.

Figure 5:
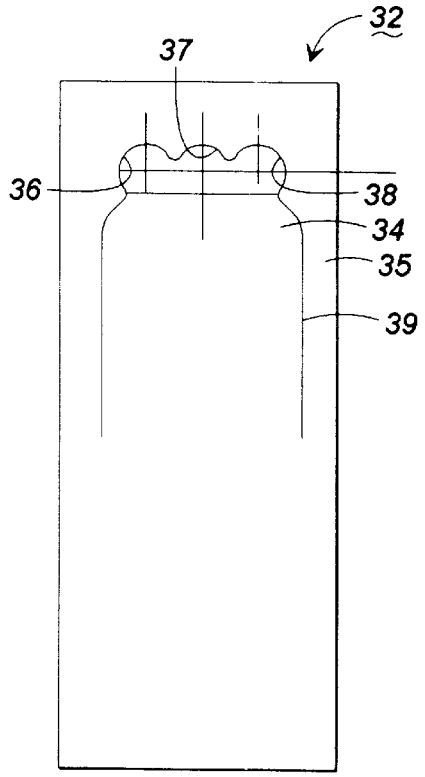
FIG. 5 is a bottom plan view of a box according to this invention.

FIG. 5 shows a bottom wall 30 of a box 32 of this invention having a tear flap 34 that can be torn open to provide a selected one of any one of three different tube openings 36, 37 or 38. The tear flap is defined by a series of perforations 39 as is well-known.

Figure 6:
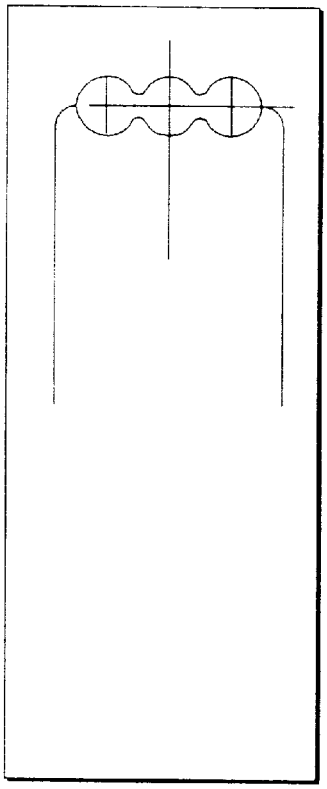
FIG. 6 is a bottom plan view of a box of another embodiment of this invention.

FIG. 6 is a view similar to FIG. 5 showing a modified tear flap and tube opening shapes.

Figure 2:
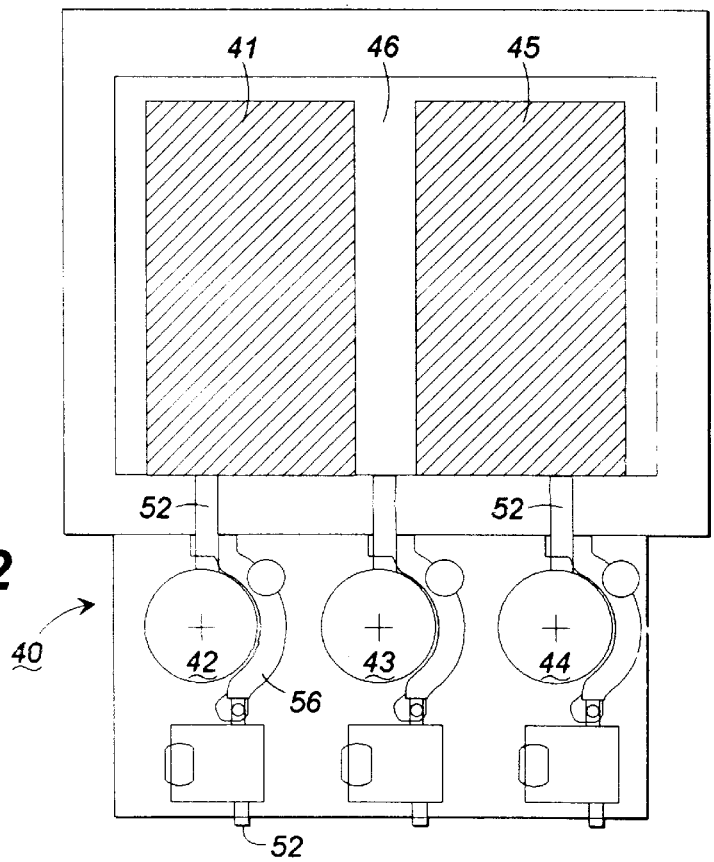
FIG. 2 is a diagrammatic front elevational view of a dispenser using the package and method of this invention.
Figure 3:
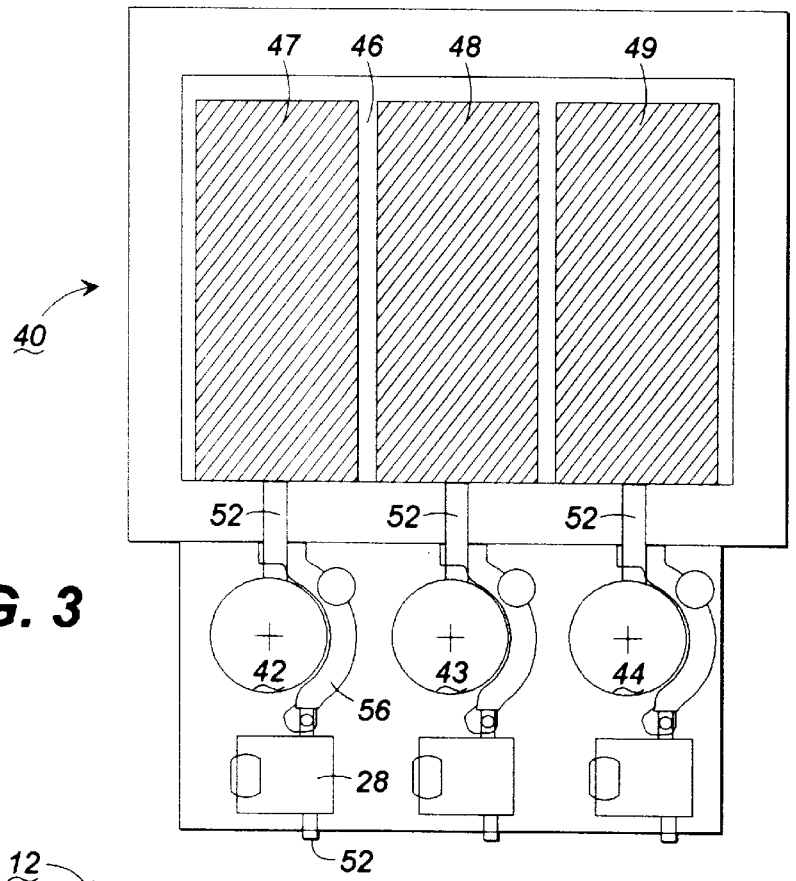
FIG. 3 is another diagrammatic front elevational view of a dispenser using the package and method of this invention.

FIGS. 2 and 3 show a dispenser 40 having three peristaltic pumps 42, 43 and 44 and a package chamber 46 large enough to accommodate for example, either three ½ gallon bag-in boxes 47, 48 and 49 (see FIG. 3) or two one gallon bag-in-boxes 41 and 45.

When using two one gallon boxes as in FIG. 2, the outer tube openings 36 and 38 of the box 32 (FIG. 5) would be used. When using three ½ gallon boxes as in FIG. 3, the center tube opening 37 of box 32 (FIG. 5) would be used.

Figure 8:
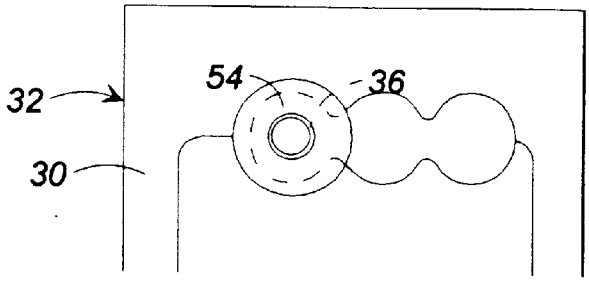
FIG. 8 is a partial bottom plan view of the box of FIG. 7 of this invention.
Figure 7:
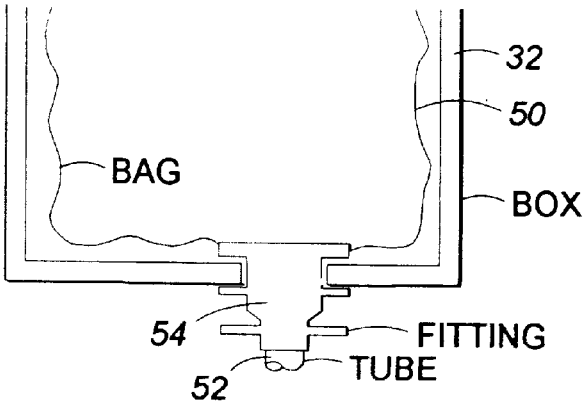
FIG. 7 is a partial cross-sectional view of a bag-in-box with the discharge tube pulled out into the box opening.
Figure 9:
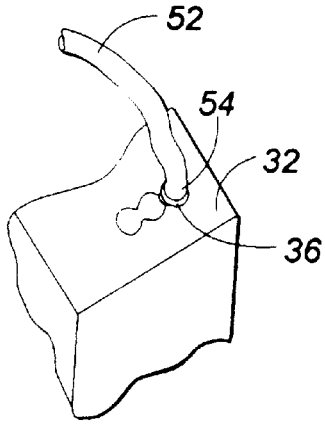
FIG. 9 is a partial, bottom, front, side perspective view of the box of FIG. 7.

FIGS. 7–9 show a bag 50 in the box 32 of this invention with its tube 52 extending through tube opening 36 in the box wall 30, usually the bottom wall of the box, and the corrugated wall extending in grooves in the tube fitment 54 as is known in the art to hold in fitment in place.

That tube opening is selected that is in alignment with the pump, that is, in alignment with the tube passageway 56 in the pump. If this alignment is not met, then the proper ratio of water to concentrate may not be achieved because of distortions in the tube trying to angle it to the pump, and possibly the tube would not be long enough to reach to the clamp.

While the preferred embodiment of this invention has been described above in detail, it is to be understood that variations and modifications can be made therein without departing from the spirit and scope of the present invention.

Instead of using a single large tear flap, a plurality of separate smaller tear flaps can be used. Other means to produce the tube openings can be used in place of tear flaps produced by a series of perforations, such as score lines, x-cuts, etc. The tube opening locations are preferably on the bottom wall but can alternatively be on other walls.

What is claimed is:

1. A box for a concentrate bag-in-box package using a bag with a discharge tube for use with a peristaltic pump comprising:

a wall having a plurality of separate tube opening locations in different positions on said wall;

said wall including means defining said opening locations and for manually converting a selected one of said opening locations into openings.

2. The box as recited in claim 1 wherein said defining and converting means includes a series of perforations.

3. The box as recited in claim 1 wherein said means comprises a tear flap.

4. The box as recited in claim 1 including a bag therein, said bag including a discharge tube.

5. The box as recited in claim 1 including two one gallon sizes of said boxes inserted into a beverage dispenser having three peristaltic pumps and room for three ½ gallon bag-in-box concentrate packages.

6. The apparatus as recited in claim 5 wherein said two boxes have bags connected to two of said pumps and the third pump is not connected to a bag.

7. A method for installing a concentrate bag-in-box in a multi-flavor postmix dispenser having a plurality of peristaltic pumps comprising the steps of (a) providing a box for a bag having a discharge tube, said box having a wall with a tear flap defining a plurality of different tube opening locations, (b) selecting that one of said opening locations that is in alignment with the respective pump;

(c) tearing said tear flap to open said selected opening;

(d) pulling said discharge tube through said opening;

(e) inserting said box into a dispenser; and (f) positioning said tube into the respective pump.

* * * * *